United States Patent [19]

Switzer

[11] Patent Number: 4,492,051

[45] Date of Patent: Jan. 8, 1985

[54] MODULAR CARTRIDGE LOADING BOARD SYSTEM

[76] Inventor: Robert D. Switzer, 149 Highview Dr., Ft. Thomas, Ky. 41075

[21] Appl. No.: 533,236

[22] Filed: Sep. 19, 1983

[51] Int. Cl.[3] ..... F41C 27/00; F42B 39/04

[52] U.S. Cl. ..... 42/87

[58] Field of Search ..... 42/87–89; 206/3

[56] References Cited

U.S. PATENT DOCUMENTS

| | | | |
|---|---|---|---|
| 2,920,893 | 1/1960 | Walker | 42/87 |
| 3,990,170 | 11/1976 | Griffis | 42/89 |
| 4,015,358 | 4/1977 | Amos | 42/87 |
| 4,027,417 | 6/1977 | Swatek | 42/87 |

FOREIGN PATENT DOCUMENTS

| | | | |
|---|---|---|---|
| 566757 | 1/1945 | United Kingdom | 42/89 |

OTHER PUBLICATIONS

HKS Competition Ammo Box Brochure; HKS Products Inc.; Dayton, KY.

*Primary Examiner*—Charles T. Jordan

*Attorney, Agent, or Firm*—Wood, Herron & Evans

[57] ABSTRACT

A modular cartridge loading board system comprised of a series of individual cartridge storage blocks, the blocks being mountable on a backing board in any matrix configuration desired by the user. Each cartridge storage block is comprised of a base plate and a series of axially parallel cartridge tubes extending outwardly from one surface of the plate, the tubes being oriented on a locus of points and being equal in number to the locus and number of chambers in the cylinder of a user's hand gun. Each tube is provided with a dual seat configuration interiorly thereof so as to seat either a round nose cartridge or a flat nose cartridge in substantially non-jiggling fashion when the cartridge is positioned nose down within the tube. When a storage block is filled with either round nose or flat nose cartridges, the cartridges are easily transferred to a cartridge loader and, subsequently, from the cartridge loader to the cylinder's chambers of the user's hand gun.

15 Claims, 5 Drawing Figures

MODULAR CARTRIDGE LOADING BOARD SYSTEM

This invention relates to a quick loading system for guns. More particularly, this invention relates to a loading system by which a series of cartridges can be quick loaded into plural chambers of a hand gun.

Competition shooting is often used by various police agencies in an effort to improve the shooting accuracy of policemen. Further, competition shooting for pleasure and relaxation by others is also common in gun clubs around the country. Such competition shooting is, of course, generally segregated according to the gun type used.

One basic type of competition shooting makes use of hand guns in the form of revolvers. As is well known, revolvers are normally loaded by hand, the five or six chambers of the revolver's cylinder being manually loaded one cartridge at a time. However, in competition shooting there normally is a time limit over which a series of shots can be fired, e.g., twelve cartridges must be fired in twelve seconds. And when more cartridges must be fired in a time period than can be carried in the chambers of the revolver's cylinder, the revolver must be reloaded during that time period. In other words, it is to the advantage of the competition shooter to be able to reload the chamber of his hand gun's cylinder within as short a time as possible during any given round of shooting so as to provide maximum time for aiming and shooting at the target, i.e., so as to minimize the time necessary for reloading the hand gun.

There are cartridge loaders known to the prior art which materially increase the speed with which the chamber of a revolver's cylinder can be loaded and reloaded, and which greatly facilitates the loading of that hand gun, by the user. A cartridge loader basically functions to retain a number of cartridges in temporary storage which are equal to the number of chambers in the hand gun's cylinder (e.g., six cartridges for a six chamber hand gun), and to retain those cartridges in parallel alignment on a locus of points which is dimensioned the same as the locus of points defined by the chambers in the hand gun's cylinder. When reloading of the revolver is required, the cartridge loader with stored cartridges is interposed in operational relation with the revolver's cylinder, and all cartridges are released simultaneously into the chambers of that cylinder. Since all cartridges are loaded simultaneously, reloading of the revolver is accomplished quickly and simply relative to the alternative of loading one cartridge at a time.

One type of cartridge loader that has seened significant commercial success in the marketplace is that disclosed in U.S. Pat. Nos. 3,722,125, 4,202,124 and 4,313,275, all invented by the inventor of the modular cartridge loading board system of this invention. The cartridge loader illustrated in those patents is basically comprised of a bored casing, and a star-shaped latch structure fixed in place on a centerpost, the centerpost (and, hence, the latch structure) being rotatable relative to the casing. The casing is provided with a plurality of cartridge bores aligned parallel to, and symmetrically oriented about, the centerpost's axis, the casing bores cooperating with the latch to retain cartridges in temporary storage with the loader. The casing's bores are of a length shorter than the cartridges to be stored therein so the cartridges' nose ends extend beyond one casing end face when stored within the bores, thereby permitting the cartridges' nose ends to be preliminarily positioned within the chambers of a revolver's cylinder before unlatching same from the loader. The star-shaped latch includes a plurality of star points that cooperate with the casing's bores and the cartridge's flanges for alternately capturing and releasing the cartridges depending on the rotational position of the latch. The rotational limits of the latch structure are defined by a stop structure that locates the rotational position of the centerpost in either a capture or a release position only. This prior art type cartridge loader materially increases the speed with which a revolver can be loaded and reloaded, and greatly facilitates the loading of that revolver, by a user.

In competition shooting, as before referred to, it is often the case that the shooter must expend sixty cartridges to ninety cartridges or one-hundred and twenty cartridges or more in a shooting event. And the total number of cartridges to be shot in competition shooting may vary from one tournament or shoot to another. In other words, and in competition shooting, the total number of shooting rounds which is required of the shooter will result in the shooting of many loads of cartridges from the hand gun. And this, in turn, of course requires that the revolver be reloaded many times. But cartridge loaders of the prior art as referred to above, and as illustrated in the above referred to patents, each only store a number of cartridges equal to the number of chambers in the hand gun's cylinder. For example, and for a sixty cartridge round of competition, ten such loaders with six cartridges apiece would have to be carried by the user of a six chamber hand gun. Accordingly, it is necessary to provide a storage system by which a large number of cartridges may be held in potential loading position in order that same can be quickly transferred from that storage position to the chambers of a hand gun's cylinder. And toward this end objective, a loading board system is known to the prior art.

The prior art loading board system includes a base plate and a series of groups of cartridge tubes upstanding from that base plate. Each group of tubes has a number of tubes equal to the number of chambers in the hand gun's cylinder. The cartridge tubes are each sized to receive a single cartridge and hold it in a vertical position, the tubes being aligned parallel to one another and oriented on a circular locus of points identical to that locus defined by the chambers of the hand gun's cylinder. With cartridges positioned in the cartridge tubes of each group on the base plate so that the flange ends of the cartridges are exposed, a cartridge loader such as that disclosed in the above patent can easily pick up each series of cartridges when reloading of the cylinder of the user's hand gun is desired. Typically, the loading board system will include ten groups of circularly aligned cartridge tubes, thereby providing the competition shooter with ten reloads by which cartridges can be transferred from a storage position on the base plate to the hand gun's cylinder through use of a single cartridge loader.

The cartridge loading board system of the prior art, as discussed in the paragraph immediately above, provides a fixed number of cartridge reloads. In other words, this prior art cartridge loading board system can only accommodate a number of cartridge reloads which is equal to the number of cartridge tube groups provided on the base plate. And since the loading board system is orignially formed with a predetermined number of tube groups thereon, same can not be modifed or changed by the competition shooter to increase or decrease the number of potential reloads depending on the requirements of the competition shoot. More specifically, if the prior art loading board system is formed for storing ten groups of six cartridges apiece, the board cannot be modified by the user for storing ten groups of six cartridges each or twelve groups of six cartridges each or eight groups of six cartridges each, or whatever other number of groups may be desired depending on the rules of the competition shoot which the hand gun's user wishes to enter. Therefor, and for example, if the total number of cartridges to be shot in the competition shoot is equal to eighty-four, i.e., fourteen reloads of the hand gun's six chambers, and if the prior art loading board system only holds ten such reloads, then the system itself must be partially reloaded with individual cartridges by hand during the competition shoot or the last four loads of the shooter's cartridge reloader must be reloaded by hand. And because of the fixed time frame within which cartridges must be shot in the competition shoot, and because it is desirable to minimize reloading time and maximize shooting time in the competition shoot, such may result in significant time lost to the competition shooter. No competition shooter wishes to waste time reloading in a time controlled competition shoot.

Accordingly, it has been the primary objective of this invention to provide a modular cartridge loading board system in which a backing board can be provided with any number of cartridge storage blocks, each of the storage blocks having a number of cartridge tubes equal to the number of chambers in a hand gun's cylinder, and each of the storage blocks being individually mountable on a backing board in whatever matrix configuration is desired by the user, thereby permitting a backing board to be provided with a desired number of cartridge storage blocks, in any desired matrix configuration, which is necessary to accommodate all cartridges to be shot in a competition shoot.

A further objective of this invention has been to provide a novel storage block for a cartridge loading board system in which the individual cartridge tubes are each structured so as to be able to store either round nose cartridges or flat nose cartridges in the same tube, and in stable alignment, to permit easy and simple pick up of a group of either type cartridge from the storage block by a cartridge loader.

In accord with this objective, the modular cartridge loading board system of this invention includes a series of individual cartridge storage blocks, the blocks being mountable on a backing board in any matrix configuration desired by the user. Each cartridge storage block is comprised of a base plate and a series of axially parallel cartridge tubes extending outwardly from one surface of the plate, the tubes being oriented on a locus of points and being equal in number to the locus and number of chambers in the cylinder of a user's hand gun. Each tube is provided with a dual seat configuration interiorly thereof so as to seat either a round nose cartridge or a flat nose cartridge in substantially non-jiggling fashion when the cartridge is positioned nose down within the tube. When a storage block is filled with either round nost or flat nose cartridges, the cartridges are easily transferred to a cartridge loader and, subsequently, from the cartridge loader to the cylinder's chambers of the user's hand gun.

Other objectives and advantages of the invention will be more apparent from the following detailed description taken in conjunction with the drawings in which.

Figure 1:
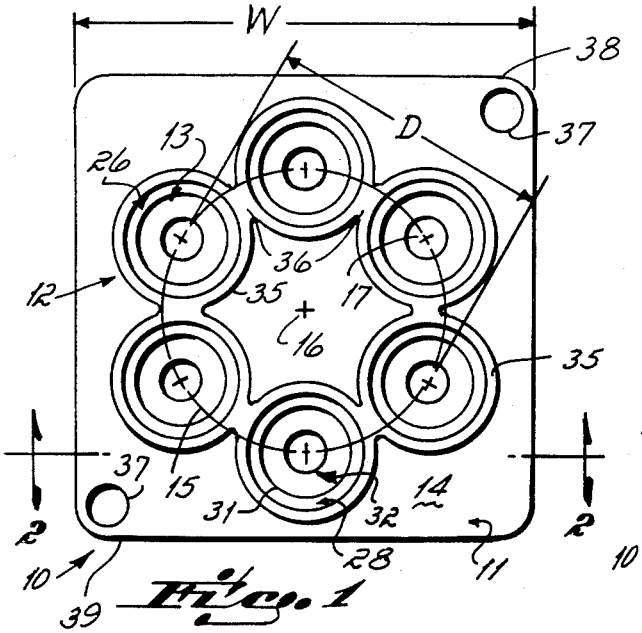
FIG. 1 is a top view of a modular cartridge storage block in accord with the principles of this invention.
Figure 3:
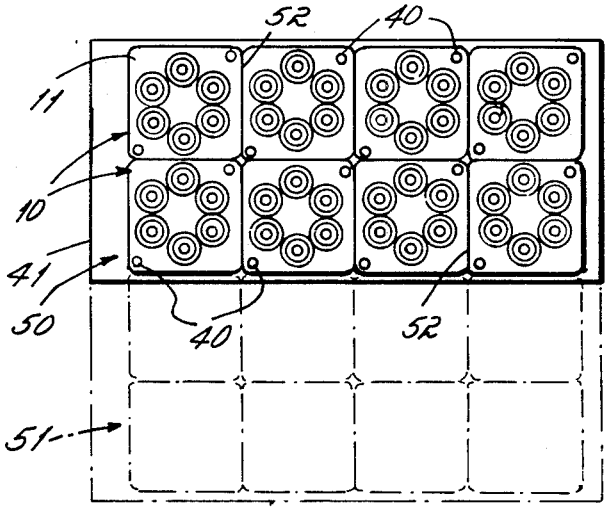
FIG. 3 is a top view of a series of modular cartridge storage blocks in a first matrix configuration shown in solid lines, and in a second matrix configuration shown in solid and in dashed lines.
Figure 5:
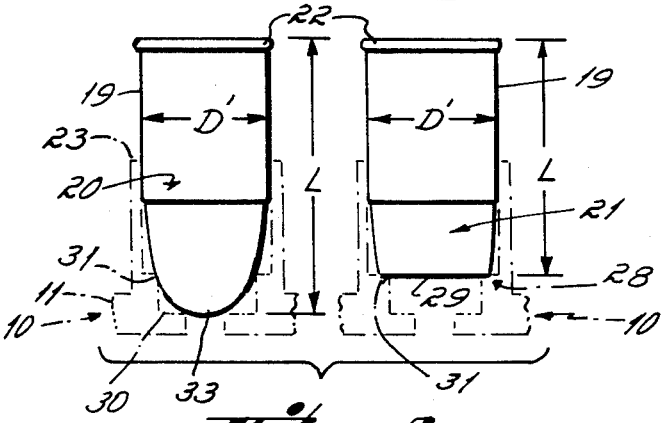
FIG. 5 is a side view of a round nose cartridge and a flat nose cartridge of the type with which this loading board system is adapted to cooperate.

A modular cartridge storage block 10 in accord with the principles of this invention is illustrated in FIG. 1. The block 10 includes a base plate 11 and a group 12 of cartridge tubes 13 extending upwardly from the top face 14 of that base plate. The cartridge tubes 13 are disposed in a circular locus of points 15 around a center axis 16, and the cartridge tubes each have an axis 17 aligned parallel to that vertical center axis. In the embodiment shown, six cartridge tubes 13 are illustrated in a group 12 of a block 10. Most hand guns (not shown) of the plural cartridge type incorporate six chamber bores (not shown) in the hand gun's cylinder (not shown). And of course, the number of cartridge tubes 13 on the base plate 11 are equal to the number of chambers in that hand gun's cylinder with which the modular loading board system of this invention is adapted for use. Note the cartridge storage blocks 10 are each of a square configuration with right angled corners, same promoting ease in aligning the blocks in abutting relationship in the matrix configuration desired by a user as shown in FIG. 3. The width W of each base plate 11 is preferably between about 1.2 and about 2.0 times the diameter D of the circular locus of points 15.

Each of the cartridge tubes 13 is of a height H above the base plate's top face 14 which is significantly shorter than the length L of the cartridges 20, 21 to be stored therein so that the cartridges' flange ends 22 extend well beyond the free ends 23 of the cartridge tubes when the cartridges are stored therein. However, the diameter $D_t$ of the cartridge tubes 13 is only slightly greater, e.g., a couple of thousandths of an inch, than the outside diameter D' of the casings of the cartridge 20, 21 to be stored therein. This nominal clearance between each cartridge casing's outside surface 19 and each cartridge tube's inside surface 23 prevents significant wobble of the cartridges 20, 21 when they are stored within the cartridge tubes 13. This, in turn, maintains and insures proper alignment of the cartridge's flange ends 22 on that circular locus of points (not shown) which insures that a cartridge loader (such as that shown in U.S. Pat. Nos. 3,722,125, 4,202,124 and 4,313,275) can easily slide over those cartridges' flange ends in order to pick up the cartridges 20, 21 with the cartridge loader from the storage block 10 when desired.

Figure 2:
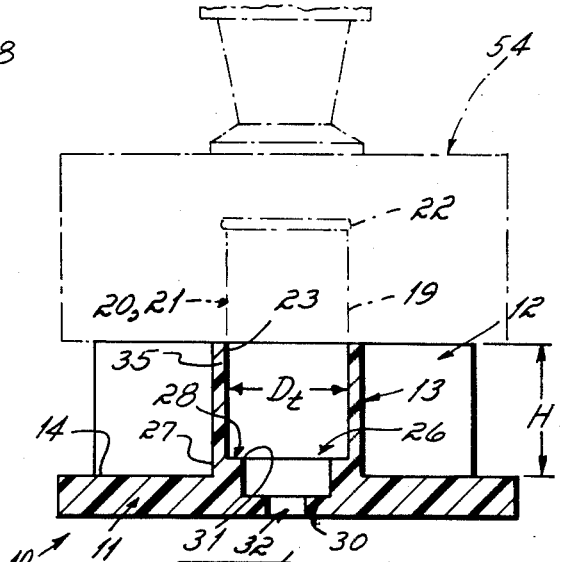
FIG. 2 is a cross-sectional view taken along line 2—2 of FIG. 1.

Each cartridge tube 13 defines a double seat 26 at its inner or base plate end 27 as shown in FIG. 2. The double seat 26 includes an upper seat 28 on which the flat end 29 of a flat nose bullet 21 is adapted to seat. The double seat 26 also includes a lower seat 30 defined by the base plate's top face 14 and rim 31 of the upper seat.

A center hole 32 is bored through the base plate 11 centrally of the lower seat 30, and this center hole cooperates with the upper seat's rim 31 and the base plate's top face 14 seat so as to provide a centered position for round nose 33 of round nose bullets 20. Further, and because flat nose bullets 21 are normally somewhat shorter than round nose bullets 20 of the same size, the upper 26 and lower 30 seats for the flat nose 21 and round nose 22 bullets, respectively, cooperate with the height H of the cartridge tubes 13 to insure that neither round nose nor flat nost bullets wobble unduly out of position (relative to that position desired when same are to be picked up by a cartridge loader) when stored in the cartridge block 10. The center hole 32 in the base plate also functions as a dirt clearance hole to allow the cartridge's tubes 13 of the modular cartridge storage block 10 to be easily cleaned.

Note that each cartridge storage block 10 is provided with a throughbore 37 at two diametrically opposed corners 38, 39 thereof relative to axis 16. These throughbores 37 cooperate with fasteners, e.g., brads or small screws 40, in fixing each storage block 10 to a backing board 41 in a position desired by the end user. Note also, as shown in FIG. 1, that side walls 35 of successive cartridge tubes 13 within each group 12 are molded integral one with the other at those locations, as at 36, where same are adjacent one to the other. This provides additional strength for each of the cartridge tubes 13 individually, as well as for the cartridge storage block 10 itself, and permits the block 10 be easily molded in one piece out of plastic.

In one form of this embodiment, the cartridge storage blocks 10 are individually formed separate and apart one from the other as shown in FIGS. 1 and 2. And this embodiment, of course, each block 10 includes just a single group 12 of cartridge tubes 13 disposed in chamber configuration for a hand gun's cylinder on the top face 14 of the base plate 11. And with cartridge storage blocks 10 of this embodiment, same can be aligned and oriented in any matrix 50 or 51 configuration desired on a backing board 41 simply by placing same in edge 52 abutting relation one to the other. In this regard, see the solid line 2×4 rectangular matrix configuration of storage blocks 10 as shown in solid lines in FIG. 3, and 4×4 square matrix configuration of storage blocks as shown in solid and in dashed lines in FIG. 3. Alternatively, the storage blocks can be spaced (not shown) one from another on a backing board 41 if desired by the end user, or can be oriented in a generally concentric circular matrix configuration (not shown) if desired by the user, or in any other type matrix configuration desired. This for the reason, of course, that each modular cartridge storage block 10 is an independent unit that can be positioned as desired by the end user on the backing board 41. When the matrix configuration of the modular cartridge storage blocks 10 is established on the backing board 41, i.e., when the total number of storage blocks desired are oriented as desired on the backing board, same are secured to the backing board itself. As noted, the storage blocks 10 may be fixed to the backing board 41 by small nails or by small screws 40 through use of connector holes 37 provided at opposite corners of each storage block's base plate 11. Such small nails or small screws 40 are particularly useful when the backing board 41 is fabricated of wood, e.g., a plywood board. The direct connection of each modular cartridge storage block 10 to the backing board 41 by the fasteners 40 functions to maintain and restrain the exact number of storage blocks 10 desired on the backing board in the exact matrix configuration desired by the end user. And the number of cartridge storage blocks 10 so mounted normally will be dependent on the number of cartridges which must be fired by the shooter in a competition shoot when the modular cartridge loading board system of this invention is used in connection with a competition shoot.

Figure 4:
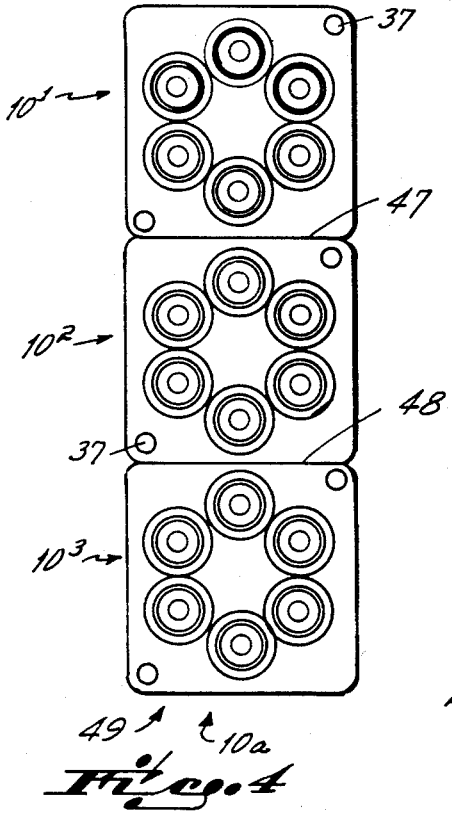
FIG. 4 is a top view of plural modular cartridge storage blocks fixedly connected together one with another prior to being set up in a matrix configuration on a backing board.

An alternative embodiment to the individual modular cartridge storage block 10 shown in FIGS. 1–3 is a plural modular storage block **10*a* in a strip 49 as shown in FIG. 4. In FIG. 4, plural modular cartridge storage blocks $10^1$, $10^2$ & $10^3$ are separably connected together one with another along weakness lines 47, 48. For example, and when the plural cartridge storage blocks $10^1$–$10^3$ are molded of a plastic, the plastic mold can be structured to insure that weakness lines, i.e., lines of separation 47, 48 are established between successive cartridge storage blocks in a plural number or series of such blocks so as to separably connect same one to the other. When individual modular blocks $10^1$ and/or $10^2$ and/or $10^3$ are desired for separation from the strip 49 of such blocks, the individual blocks $10^1$–$10^3$ need merely be broken off relative to adjacent blocks by bending along the lines of weakness 47, 48. Accordingly, such strips 49 of modular cartridge storage blocks $10^1$–$10^3$ can be separated into individual storage blocks 10 as required in order to make up either the solid line matrix configuration, or the solid and dashed line matrix configuration, on the backing board 41 as shown in FIG. 3**, as well as any other matrix configuration desired by the end user.

In use of the modular cartridge loading board system of this invention, and after the modular cartridge storage blocks 10 have been fixed to a backing board 41 in a preferred matrix configuration as shown in FIG. 3, the groups of cartridge tubes 13 on each cartridge storage block are filled with cartridges 20 or 21. In the solid line matrix configuration shown in FIG. 3, eight such storage blocks 10 are filled with six cartridges apiece for a total of forty-eight such cartridges. During a competition shoot, therefore, the shooter will reload the six chambers of his hand gun's cylinder with successive groups of six cartridges stored in successive cartridge storage blocks. Loading is accomplished through use of a cartridge loader 54 such as that shown in U.S. Pat. Nos. 3,722,125, 4,202,124 or 4,313,275. The cartridge loader is simply installed over the flange ends 22 of each group of six cartridges 20 in any cartridge storage block (the loader being shown in phantom lines in FIG. 2) while the loader's latch is retracted. After the cartridge loader 54 is properly positioned over the flange 22 ends of the cartridges 20 in a loader block 10, the cartridge's latch is rotated to the latch position so as to capture the cartridges within the loader. The cartridge loader 54 is then moved manually from the loading board system's backing board 41 (which, of course, draws the cartridges 20 out of the cartridge tubes 13) into proximity with the hand gun's cylinder. And the cartridges 20 are then loaded into the hand gun's cylinder (not shown) from the cartridge loader 54.

The exact structure and use of a cartridge loader 54 adapted to cooperate with the modular cartridge loading board system of this invention is described and is illustrated in the aforementioned U.S. Pat. Nos. 3,722,125, 4,202,124 and 4,313,275. The descriptions and illustrations of those aforementioned U.S. patents are hereby incorporated herein by reference.

Having described in detail the preferred embodiment of my invention, what I desire to claim and protect by Letters Patent is:

1. A modular cartridge loading board system comprising a plurality of modular cartridge storage blocks, each of those blocks having a series of cartridge tubes oriented on a generally circular locus of points and upstanding from one face of a base plate, said cartridge tubes being sized to receive a load of cartridges equal in number to the number of cartridge chambers in a hand gun's cylinder with which the cartridges are adapted for use, a backing board on which said cartridge storage blocks are adapted to be connected, and fasteners by which said cartridge storage blocks are connectable to said backing board, said plurality of cartridge storage blocks, fasteners and backing board being cooperable one with the other to provide a matrix of said cartridge storage blocks in connected fashion on said backing board as desired by the end user.

2. A modular cartridge loading board system as set forth in claim 1, each of said base plates having a generally square configuration, the width of each base plate being between about 1.2 and about 2.0 times the diameter of said generally circular locus of points.

3. A modular cartridge loading board system as set forth in claim 1, each of said base plates comprising at least two through bores located on diametrically opposite sides thereof, and said fasteners comprising one of nails and screws, said storage blocks being connected to said backing board by nailing or screwing said base plate through said through bores to said backing board.

4. A modular cartridge loading board system as set forth in claim 1, each of said cartridge tubes being structured to receive both round nose cartridges and flat nose cartridges in such fashion as to maintain the axes of same in a circular locus of points at the flange ends thereof which is at least closely approximate the circular locus of points defined by said cartridge tubes.

5. A modular cartridge loading board system as set forth in claim 4, each of said cartridge tubes comprising a double seat positioned at the base plate end of said cartridge tube, said double seat being adapted to cooperate with both said round nose cartridges and said flat nose cartridges in order to hold either in storage position within said cartridges tubes.

6. A modular cartridge loading board system as set forth in claim 5, each double seat comprising an upper seat on which the flat end of a flat nose bullet is adapted to seat, and a lower seat defined by the base plate's top face, and by a rim presented by said upper seat, on which the round end of a round nose bullet is adapted to seat.

7. A modular cartridge loading board system as set forth in claim 6, said double set comprising a bore centrally positioned through said base plate axially of each cartridge tube, said bore and said upper seat's rim cooperating with said base plate's top face so as to provide a centered position for the round nose of a round nose cartridge.

8. A modular cartridge loading board system as set forth in claim 1, said system comprising a plurality of modular cartridge storage blocks temporarily connected together one with the other, and weakened separation structure that connects each of said modular storage blocks one with the other, said modular storage blocks being separable one from the other along said weakened lines of separation.

9. A cartridge storage block comprising a base plate, a series of cartridge tubes oriented on a generally circular locus of points and upstanding from one face of said base plate, said cartridge tubes being sized to receive a load of cartridges equal in number to the number of cartridge chambers in a hand gun's cylinder with which the cartridges are adapted for use, and seat structure associated with one end of each tube, said seat structure being adapted to receive both round nose cartridges and flat nose cartridges from the other end of said tube in such fashion as to maintain the axes of same in a circular locus of points at the flange ends thereof which is at least closely approximate the circular locus of points defined by said cartridge tubes.

10. A storage block as set forth in claim 9, each of said cartridge tubes comprising a double seat positioned at the base plate end of said cartridge tube, said double seat being adapted to cooperate with both said round nose cartridges and said flat nose cartridges in order to hold either in storage position within said cartridges tubes.

11. A storage block as set forth in claim 10, said double seat comprising an upper seat on which the flat end of a flat nose bullet is adapted to seat, and a lower seat defined by the base plate's top face, and by a rim presented by said upper seat, on which the round end of a round nose bullet is adapted to seat.

12. A storage block as set forth in claim 11, said double seat comprising a bore centrally positioned through said base plate axially of each cartridge tube, said bore and said upper seat's rim cooperating with said base plate's top face so as to provide a centered position for the round nose of a round nose cartridge.

13. A storage block as set forth in claim 9 comprising a plurality of cartridge storage blocks temporarily connected together one with the other, and weakened separation structure that connects each of said modular storage blocks one with the other, said modular storage blocks being separable one from the other along said weakened lines of separation.

14. A storage block as set forth in claim 9, said base plate having a generally square configuration, the width of said base plate being between about 1.2 and about 2.0 times the diameter of said generally circular locus of points.

15. A storage block as set forth in claim 9, said base plate comprising at least two through bores located on diametrically opposite sides thereof, and fasteners comprising one of nails and screws, said storage block being connectable to a backing board by nailing or screwing said base plate through said through bores to said backing board.

* * * * *

UNITED STATES PATENT AND TRADEMARK OFFICE

CERTIFICATE OF CORRECTION

PATENT NO. : 4,492,051

DATED : Jan. 8, 1985

INVENTOR(S) : Robert D. Switzer

It is certified that error appears in the above-identified patent and that said Letters Patent is hereby corrected as shown below:

Col. 3, line 65, "nost" should be -- nose --

Col. 7, Claim 7, line 60,"set" should be -- seat --

Signed and Sealed this

*First* Day of *October 1985*

[SEAL]

*Attest:*

DONALD J. QUIGG

*Attesting Officer*

*Commissioner of Patents and Trademarks—Designate*